US008220872B2

(12) United States Patent
Hong

(10) Patent No.: US 8,220,872 B2
(45) Date of Patent: Jul. 17, 2012

(54) SIT-STAND CHAIR

(76) Inventor: Simon Yeonjun Hong, Bethesda, MD (US)

( * ) Notice: Subject to any disclaimer, the term of this patent is extended or adjusted under 35 U.S.C. 154(b) by 0 days.

(21) Appl. No.: 13/326,146

(22) Filed: Dec. 14, 2011

(65) Prior Publication Data

US 2012/0086252 A1 Apr. 12, 2012

(51) Int. Cl.

| | |
|---|---|
| ***A47C 1/00*** | (2006.01) |
| ***A47C 1/022*** | (2006.01) |
| ***A47C 9/00*** | (2006.01) |
| ***A47C 7/50*** | (2006.01) |

(52) U.S. Cl. ..... 297/312; 297/313; 297/344.16; 297/344.17; 297/337; 297/423.1; 297/461

(58) Field of Classification Search ..... 297/312, 297/313, 344.16, 344.17, 461, 174 R, 337, 297/423.1

See application file for complete search history.

(56) References Cited

U.S. PATENT DOCUMENTS

| | | | | | |
|---|---|---|---|---|---|
| 483,265 | A | * | 9/1892 | Schindler | 297/313 |
| 1,478,567 | A | * | 12/1923 | Howard | 297/312 X |
| 2,620,863 | A | * | 12/1952 | Cooper | 297/461 X |
| 3,511,533 | A | * | 5/1970 | Drabert | 297/337 |
| 3,704,847 | A | * | 12/1972 | Schmitt | 297/423.1 X |
| 4,451,086 | A | * | 5/1984 | Seven | 297/312 |
| 5,253,922 | A | * | 10/1993 | Corlett | 297/344.16 |
| 5,435,623 | A | * | 7/1995 | Kapec et al. | 297/339 |
| 5,447,358 | A | * | 9/1995 | Corlett | 297/344.18 |
| 5,536,067 | A | * | 7/1996 | Pinto | 297/312 X |
| 5,630,648 | A | * | 5/1997 | Allard et al. | 297/313 X |
| 5,782,534 | A | * | 7/1998 | Desanta | 297/423.13 |
| 5,873,628 | A | * | 2/1999 | Allard et al. | 297/326 |
| 6,102,475 | A | * | 8/2000 | Hamann | 297/174 R X |
| 6,752,459 | B2 | * | 6/2004 | Deisig | 297/344.16 X |
| 6,893,090 | B1 | * | 5/2005 | Van Deursen et al. | 297/312 |
| 7,090,303 | B2 | * | 8/2006 | Kropa | 297/312 X |
| 7,293,825 | B2 | * | 11/2007 | Vergara et al. | 297/313 X |
| 7,350,863 | B2 | * | 4/2008 | Engels et al. | 297/312 X |
| 7,350,865 | B2 | * | 4/2008 | Pearse | 297/312 |
| 7,387,339 | B2 | * | 6/2008 | Bykov et al. | 297/312 |
| 7,896,442 | B2 | * | 3/2011 | White | 297/312 X |
| 2005/0088029 | A1 | * | 4/2005 | Stokes | 297/461 |
| 2008/0265641 | A1 | * | 10/2008 | Kim | 297/312 |

* cited by examiner

*Primary Examiner* — Rodney B White

(57) ABSTRACT

A sitting device that gives the user an option to sit with a lower portion of the body supported by a half seat, while maintaining a standing posture with the unsupported leg. The sitting device includes two, left and right, half seats and a foot stool. The device also includes a seat support frame and two half-seat-position-adjusting actuators. The frame includes a horizontal crossbar and a vertical guide tube, wherein the back end of each of the two half seats is pivotally secured on the horizontal bar. The vertical guide tube houses a length-changing mechanism to vary the height of the sitting device and a height fixing mechanism which prevents yielding of the height of the sitting device when the user sits. Also comprising are the two half-seat-position-adjusting actuators attached at one end of each to the vertical tube and at the other end to the respective half seat.

18 Claims, 19 Drawing Sheets

SIT-STAND CHAIR

FIELD OF THE INVENTION

The present invention relates to chairs, chair-like devices, body support devices, standing devices, and sitting devices. More specifically, the present invention is a sitting device.

BACKGROUND OF THE INVENTION

According to a study (Deyo et al., 2006), about one fourth of U.S. adults report low back pain in the past 3 months, emphasizing the prevalence and importance of this condition. It is generally accepted that prolonged, static sitting postures are likely to aggravate a preexisting low back condition or instigate the development of a new condition (Kelsey & White, 1980; Lis et al., 2007; Battié et al., 2002). Also, a recent occupational study finds that sitting hours positively correlate with lower back pain (Mendelek et al., 2011). In sitting, the pelvis rotates posteriorly and the lumbar lordosis (the natural curve of the lower back) flattens (De Carvalho et al., 2010). This posture increases the strain on the posterior passive elements of the spine (De Carvalho et al., 2010; O'Sullivan et al., 2011; Lengsfeld et al., 2000). The problem stems from the very fact that chair sitting requires raising both upper legs. This reduces the angle between the thigh and the torso from 180 degrees to near 90 degrees therefore pushing the posterior passive elements of the spine (De Carvalho et al., 2010).

There are some claver chair products increasing the thigh-torso angle by providing a knee support and a forward-tilted seat (U.S. Pat. Nos. 4,765,684; 5,782,534), thereby reducing back pain. Another category of products is standing chair (U.S. Pat. Nos. 3,704,847; 4,738,487), by which the user maintains a half-standing posture; sitting on a raised, tilted-forward seat. There are other inventions which let the user change the thigh-torso angle by having two split half seats individually tilt forward (U.S. Pat. Nos. 4,451,086; 7,387,339 B2) or mobilizing the pelvis (U.S. Pat. Nos. 6,139,095; 6,357,827 B1) while the user is in a sitting position. While these products increase the spine-thigh angle, they do not reach the ideal 180 degrees (standing posture); and the postures that the user needs to maintain are rather unnatural.

SUMMARY OF THE INVENTION

The applicant has invented a new category of chair or sitting device, which provides, in one embodiment, two half seats that are individually controlled to be in a supporting seat position or in a collapsed seat position. The sitting device effectively lets the user keep the standing posture while at least half of the body weight supported. Since the standing posture naturally keeps the lumbar lordosis, the sitting device eliminates the source of sitting-related back pain. Moreover, it also gives the user an option to use it as an ordinary chair by positioning both of the two half seats in the supporting position.

In a first embodiment, the sitting device includes two independently position-adjustable half seats. The half seats are secured to the seat support frame comprised of a horizontal cross bar and a vertical guide tube. The piston of a pneumatic cylinder or any equivalent mechanism, which is for height adjustment of the whole sitting device, is housed and travels inside the vertical guide tube of the seat support frame. The bottom of the pneumatic cylinder is secured to the base of the sitting device. At the lower portion of the vertical guide tube of the seat support frame, two perches are attached one for the left half seat-controlling actuator and the other for the right half seat-controlling actuator to be secured on. The bottom of the half seat-controlling linear actuator is secured to the perch via a bracket; the top part of the actuator is secured to the bottom of the half seat via a bracket. The position of each half seat is controlled by the length of the linear actuator, which in turn is controlled by the user via manual switches or by a programmable control box.

A second embodiment of the sitting device shares most of the mechanisms of the first embodiment except for the half seat moving mechanism. In the second embodiment, the linear actuators of the first embodiment are replaced with rotors with attached seat supporting arms, which control the positions of the half seats. Each seat supporting arm has two segments (lower part and upper part) with a joint in the middle. The bottom of the arm is attached to the rotor; the top end of the arm is attached to the bottom of the half seat via a bracket. The position of each half seat is controlled by the angular position of the rotor which in turn swings the attached supporting arm. When the supporting arm swings forward, the attached half seat rises to a supporting position; when the supporting arm swings backward, the attached half seat retracts. This swinging motion is controlled by the user via manual switches or by a programmable control box. Other alternate designs are also presented.

The sitting device of any embodiment may further include one or more of the following: a height fixing mechanism, a backrest or back support member, armrests or arm support member, any structural reinforcement mechanism, casters, a foot stool or foot support member, and any safety mechanism.

BRIEF DESCRIPTION OF THE DRAWINGS

In FIGS. 1 and 2, one half seat has been removed for clarity.

In FIGS. 5 and 6, one half seat has been removed for clarity.

FIG. 6 is a side view of the sitting device in FIG. 5.

DETAILED DESCRIPTION OF THE PREFERRED EMBODIMENTS

The present invention is a sitting device whose preferred embodiments are indicated by numbers from 1.000 through 11.000.

Figure 1:
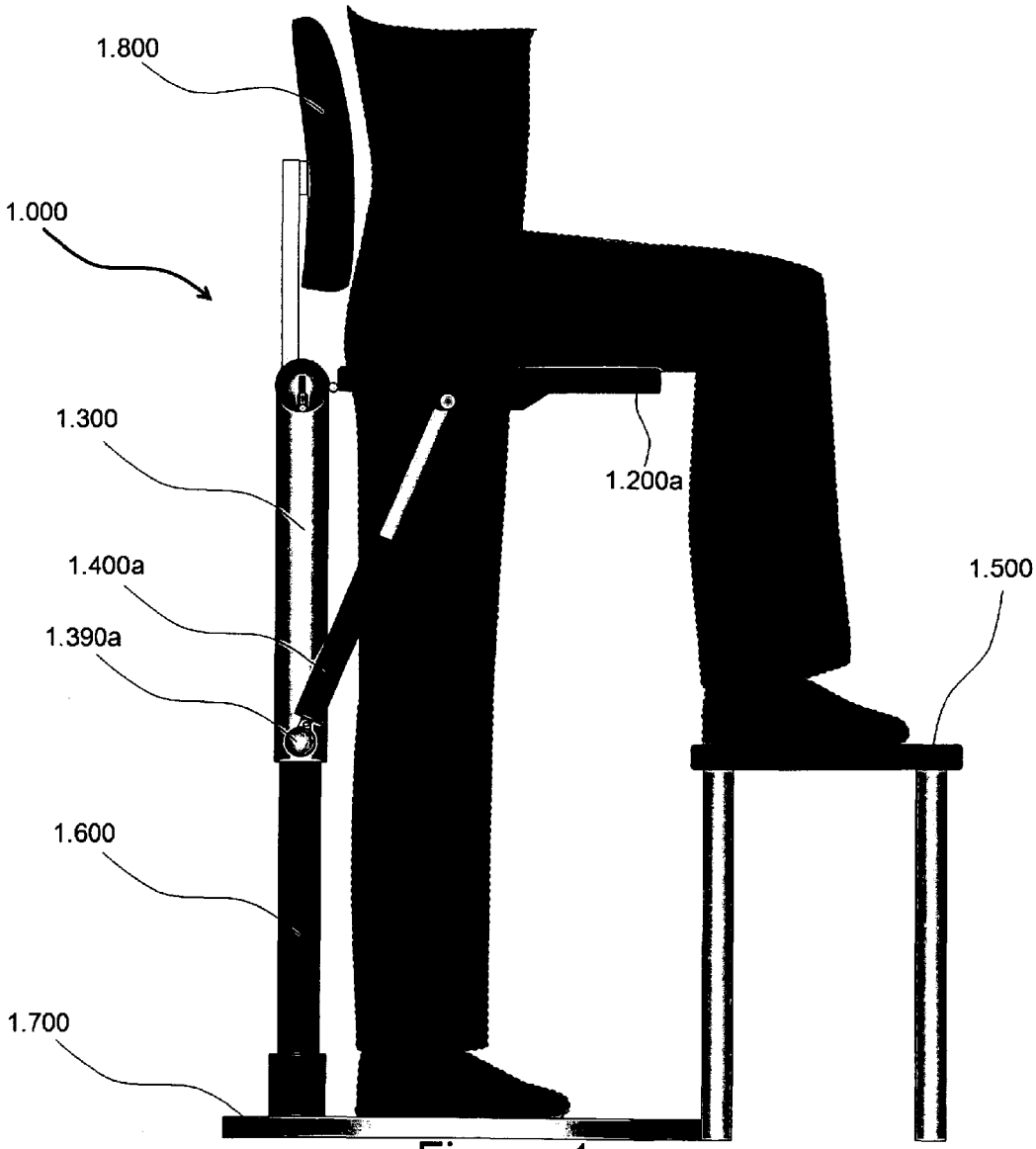
FIG. 1 is a one side view of the first embodiment of the invention, illustrating one half seat in a supporting position on which a user sits while he/she stands with the other leg. In the following figures, the foot stool has been removed for clarity.

FIG. 1 shows a lateral view of a first embodiment of the sitting device where a user sits on one of the half seats, 1.200*a* (a: right; b: left; the same convention is used throughout the text), while standing with his/her unsupported leg. For comfort, a foot stool, 1.500, is provided.

Figure 3:
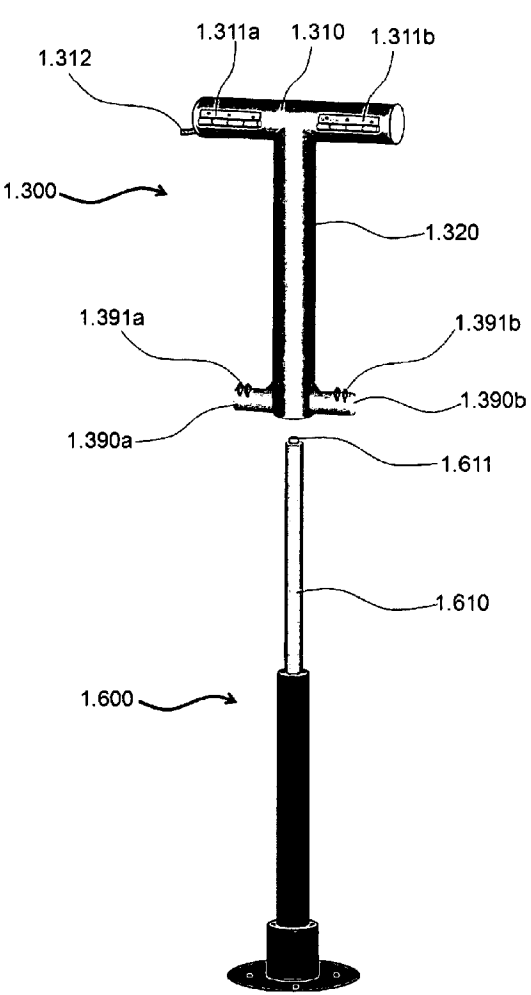
FIG. 3 is an exploded, perspective view of a height adjustment mechanism of a sitting device according to the present invention, illustrating the seat support frame (upper portion), and a pneumatic cylinder (bottom portion).

In a first embodiment and referring to FIGS. 1-9, the sitting device 1.000 includes a seat support frame or member, 1.300 to which the rear end of two half seats (1.200*a* for the right; 1.200*b*, for the left) are secured; an electric linear actuator 1.400*a*, is linked to a perch 1.390*a* jutting out from the bottom part of the support frame 1.300; the seat support frame 1.300 is supported by a pneumatic cylinder 1.600, or an equivalent mechanism, that could change the height of the sitting device via its piston 1.610 in FIG. 3 housed inside of the vertical guide tube part 1.320 of the support frame 1.300. In this preferred embodiment, the pneumatic cylinder 1.600 is a non-rotating one to prevent a pivoting motion of the sitting device around the cylinder. A wider chair base of 1.700 may be required if a rotating mechanism around the pneumatic cylinder is allowed. A pivoting motion of the whole chair can be achieved via a turn table mechanism embedded in the chair base 1.700.

Figure 2:
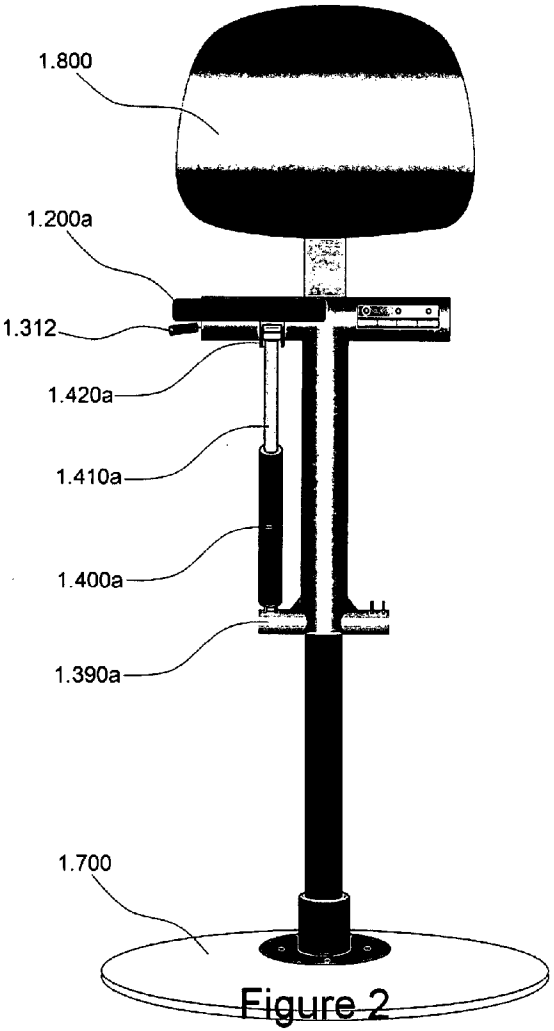
FIG. 2 is a front view of the sitting device in FIG. 1.

FIG. 2 shows a front view of the sitting device in FIG. 1. One half seat has been removed for clarity; the base part of the sitting device is illustrated as an environmental view to give a 3D sense; the same holds for the following figures. The position of the half seat 1.200*a* is controlled by a linear actuator 1.400*a*. The bottom of the actuator is linked to a perch 1.390*a* via a bracket 1.391*a* (FIG. 3) and the top is linked to the bottom of the half seat via a bracket 1.420*a*. When the piston of the actuator 1.410*a* lengthens it pushes the bottom of the half seat 1.200*a* therefore raises the half seat in a pivoting motion around the hinge 1.311*a* (FIG. 3) to a supporting position as shown in FIGS. 1 and 2. The illustration also includes a back support 1.800 and a chair base 1.700 among other possible chair mechanisms.

FIG. 3 shows an exploded, perspective view of a height adjustment mechanism of a sitting device according to the present invention. The seat supporting frame is comprised of a horizontal crossbar 1.310, a vertical guide tube 1.320 and two perches 1.390*a*, 1.390*b* with brackets 1.391*a*, 1.391*b*, accepting the linear actuators 1.400*a* and 1.400*b* (in FIG. 6). The crossbar 1.310 accepts the two half seats via the hinges 1.311*a*, 1.311*b*. A pneumatic cylinder 1.600 or other compatible height changing mechanism is inserted through the bottom of the guide tube. By lifting the height adjusting lever 1.312, which pushes the gas releasing button 1.611 on top of the piston 1.610 of the pneumatic cylinder, the piston 1.610 changes its position, therefore pushing or pulling the seat supporting frame 1.300, in turn changing the height of the sitting device. At the bottom of the vertical guide tube, a band brake 1.330 (FIG. 4) or other height fixing mechanism is housed to fix the height. Fixing the height is needed because the height of the sitting device needs to be stable to match the height of the user without yielding.

Figure 4:
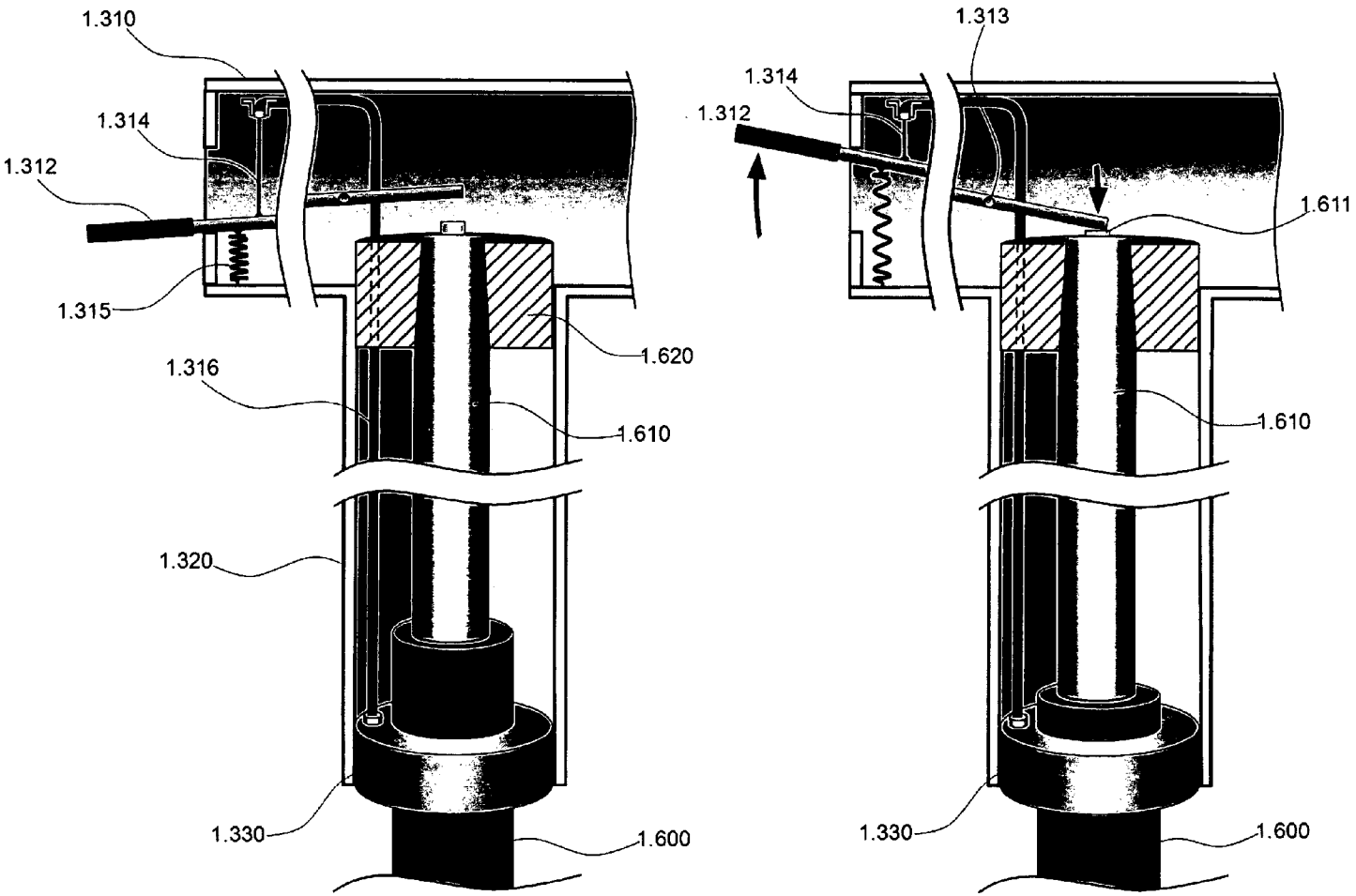
FIG. 4 shows a more detailed height-adjusting mechanism.

FIG. 4 shows a more detailed height-adjusting mechanism. The figure illustrates a cross-section of the seat supporting frame comprised of a horizontal crossbar 1.310 and a vertical guide tube 1.320. For clarity, the band-brake 1.330 and the pneumatic cylinder comprised of the piston 1.610 and its casing 1.600 are not sectioned. The crossbar 1.310 houses a spring-loaded height-adjusting lever 1.312. The top part of the guide tube 1.320 secures a socket 1.620 that secures the top of the piston 1.610 of the pneumatic cylinder 1.600 or any equivalent length-changing mechanism. The casing of a band brake 1.330 or equivalent height-fixing mechanism is secured at the bottom of the guide tube 1.320. The casing of the pneumatic cylinder 1.600 glides through the band brake 1.330 when the height is allowed to vary. The cable of the band brake 1.314 links the height-adjusting lever 1.312 and the band brake 1.330 and is protected by its case 1.316. The left panel of FIG. 4 shows the configuration of the height-adjusting mechanism when it is not in operation. During this non-height adjusting state, the spring 1.315 pulls the lever 1.312 down-ward and the cable of the band brake 1.314 is in a high tension pulled state, which in turn makes the band brake 1.330 chock the pneumatic cylinder casing 1.600 therefore fixing the height of the sitting device. The right panel in FIG. 4 shows the configuration of the height adjusting mechanism when it is in operation. When the height adjusting lever 1.312 is pushed up, as indicated by an up-ward arrow in the right panel of FIG. 4, the lever pivots around its pivot 1.313. This lifting motion makes the cable of the band brake 1.314 relax which in turn makes the band brake 1.330 release its grip on the pneumatic cylinder casing 1.600. After relaxing this height-fixing mechanism, the other end of the height adjusting lever pivots further down now pushing the gas-releasing button 1.611 on top of the piston of the pneumatic cylinder 1.610. This action in turn varies the length of the pneumatic cylinder and therefore the height of the sitting device. When the height-adjusting lever 1.312 is released, the lever first releases the gas-releasing button 1.611 therefore stopping the motion of the pneumatic cylinder and then pulls the cable 1.314 of the band brake 1.330 to fix the height. In summary, the lifting motion of the height-adjusting lever, by the user, 1) disables the height fix by releasing the grip of the band brake around the pneumatic cylinder and then; 2) engages height adjustment by pressing the gas-release button on top of the pneumatic cylinder. When the height-adjusting lever is released from the lifted position, it 1) disables the height changing mechanism by releasing the gas-releasing button on top of the pneumatic cylinder and then; 2) fixes the height by pulling the cable of the band brake.

Figure 6:
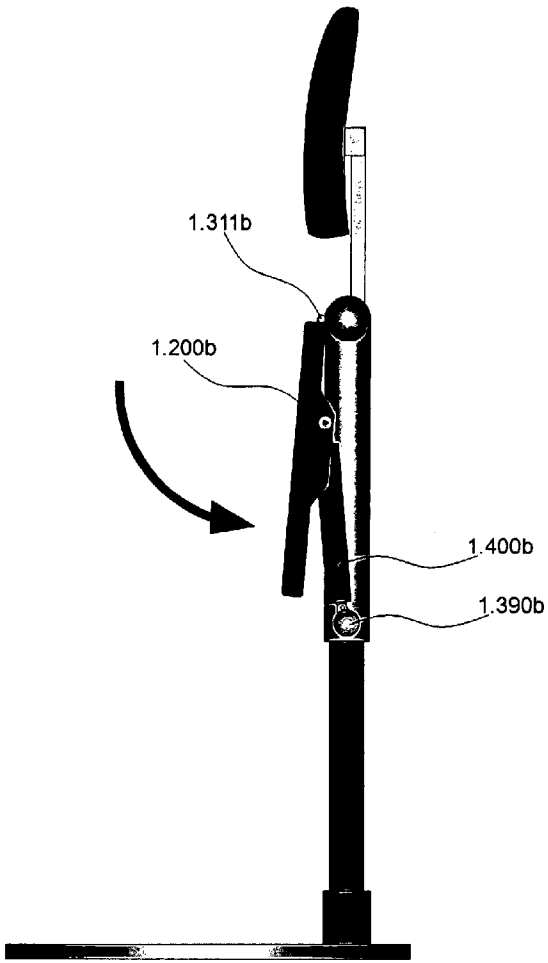
Figure 5:
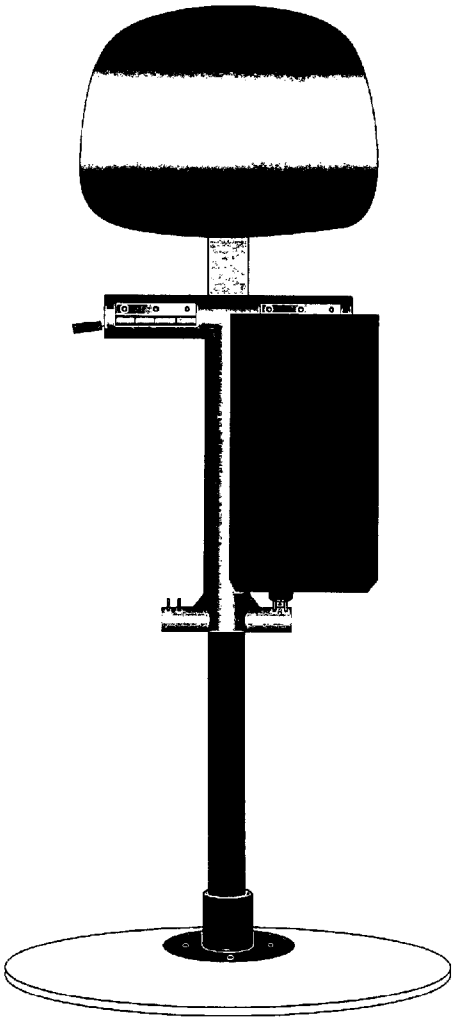
FIG. 5 is a front view of the other side of the first embodiment of the sitting device.

FIGS. 5 and 6 show a front and lateral views of another side of the first embodiment of the sitting device. When the piston (hidden in the figure) of the actuator 1.400*b* retracts, it leads the half seat 1.200*b* to a collapsed position, as illustrated in FIGS. 5 and 6, in a pivoting motion (indicated by a curved arrow) around the hinge 1.311*b*. In FIGS. 5 and 6, one half seat has been removed for clarity.

Figure 7:
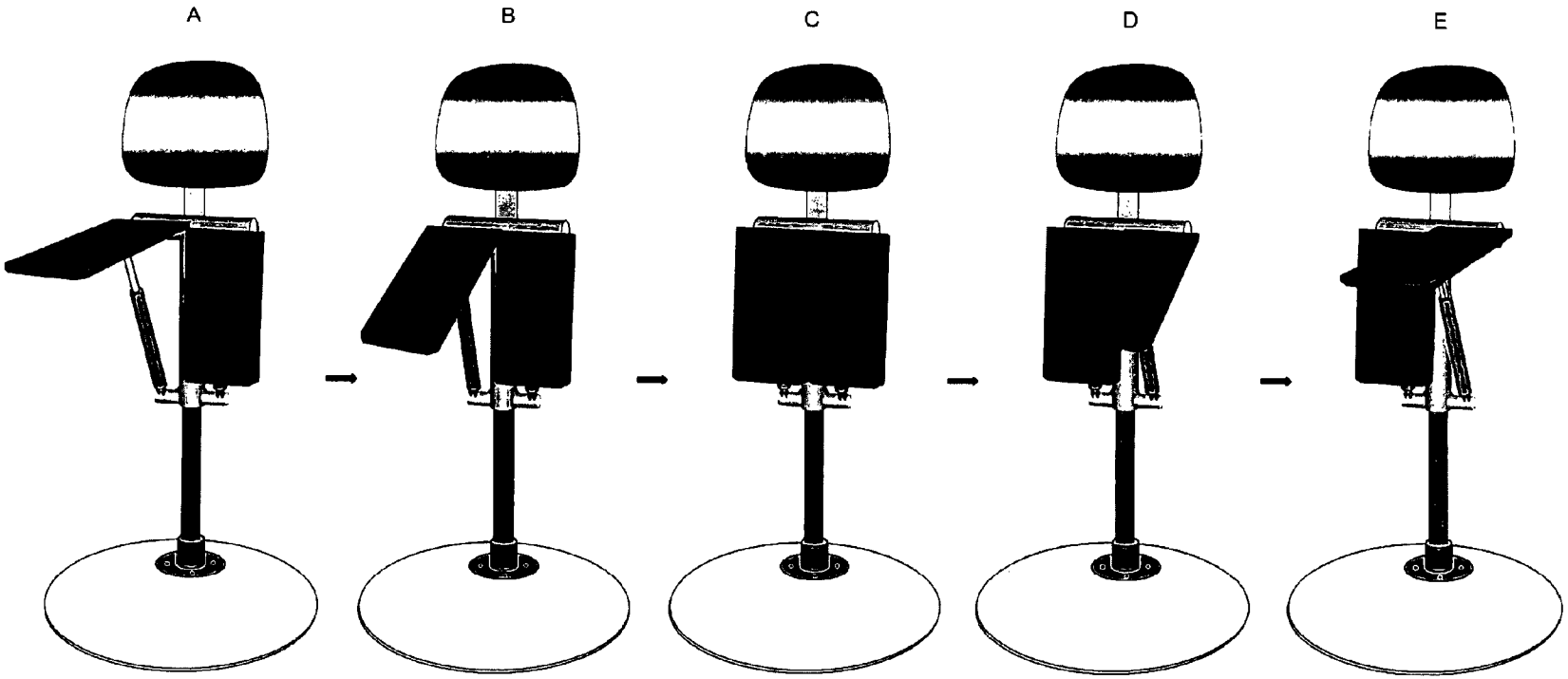
FIG. 7 is an example of a sequence of positions by the first embodiment of the sitting device.
Figure 8:
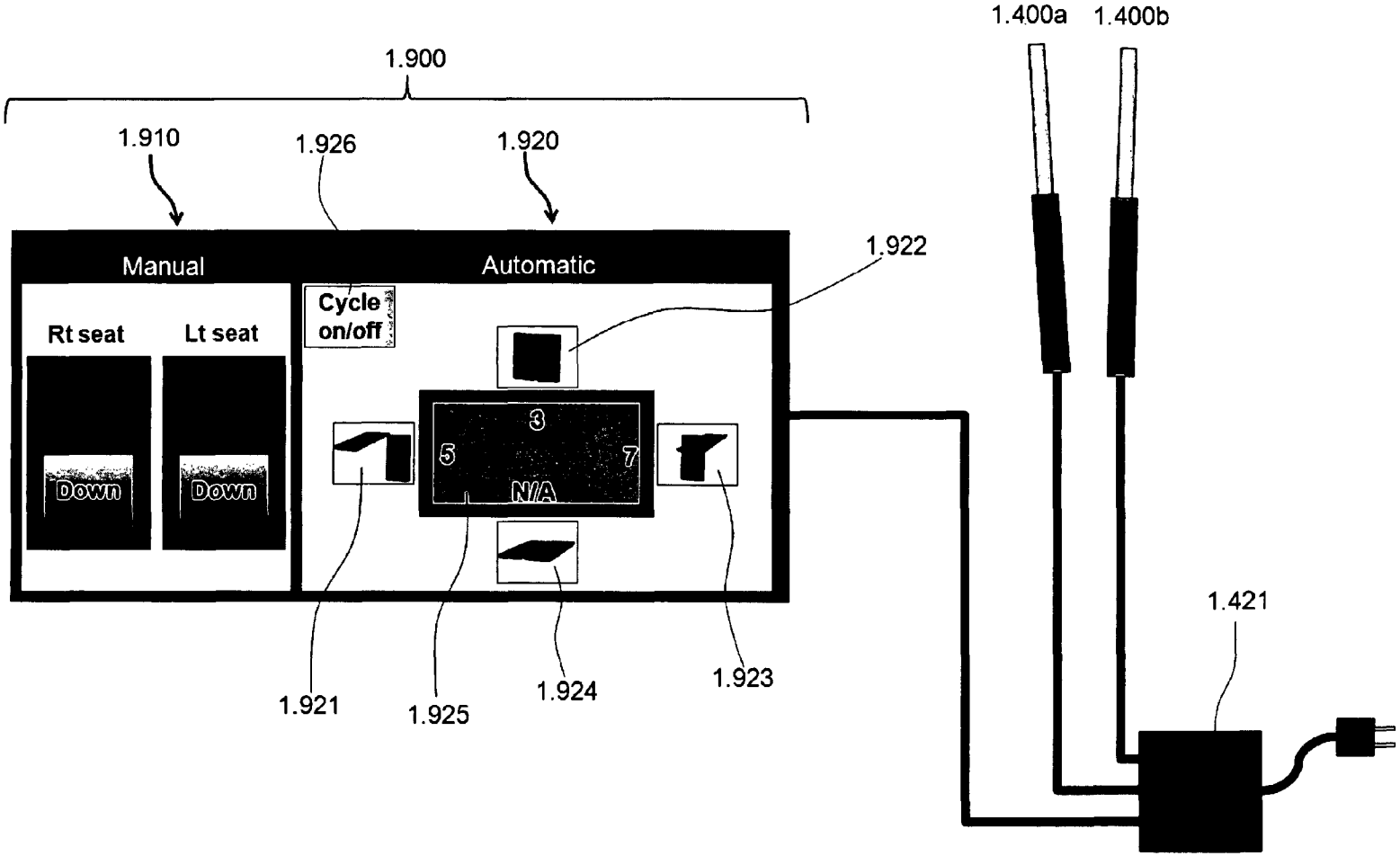
FIG. 8 shows a schematic electric circuit of the sitting device including a control box, a power supply and the actuators. The control box contains manual and automatic panels.

FIG. 7 illustrates an example of a sequence of motions by the first embodiment of the sitting device. The user can use a control box 1.900 illustrated in FIG. 8 to control the positions and sequence of positions of the half seats as he/she desires. The control box provides a manual panel 1.910 and an automatic panel 1.920. When desired, the user can manually control the position of each half seat individually using the 4 buttons (left seat up, left seat down, right seat up, right seat down) in the "Manual" panel 1.910, or program how frequently the seat positions need to change using the buttons in the Automatic panel 1.920. The automatic panel provides 5 buttons as illustrated in 1.920. The "Cycle on/off" button disables or enables the programmed cycle of seat position sequence. The other 4 buttons (1.921~1.924) each having an icon corresponding to a configuration of the two half seats provide a means to set a sequence of seat positions. When one of these buttons is pressed, the number (representing minutes) or "N/A" (representing "disabled position") indicated at the nearest part of the display panel 1.925 changes to another value (e.g., pressing the button 1.921 will increase the displayed number from 5 to 6). Each number indicates how long the configuration of the half seat positions should last. For example, the number 5 in the display panel 1.925 indicates that the configuration of "right half seat supporting and left half seat collapsed" should last 5 minutes before going to the next seat configuration. When one of these buttons is pressed the associated number on the display panel changes in a rotating manner: 0→1→2→ . . . 60→N/A→0, covering an hour. According to this scenario, the display panel 1.925 in FIG. 8 shows a set of sequence of seat configurations (5, 3, 7, N/A) corresponding to the ones in FIG. 7; namely, 5 minutes of A (right side of the user gets supported; left leg standing), 3 minutes of C (the user freely stands with two legs) and 7 minutes of E (the left side of the user gets supported; right leg standing). If desired, the user can push the button 1.924 to include the normal sitting position (shown in the left panel of FIG. 9) in the sequence. The electric circuit further includes the power supply 1.421 and the actuators 1.400*a*, 1.400*b*. The figures of B and D in FIG. 7 illustrate transient positions of the moving half seats.

Figure 9:
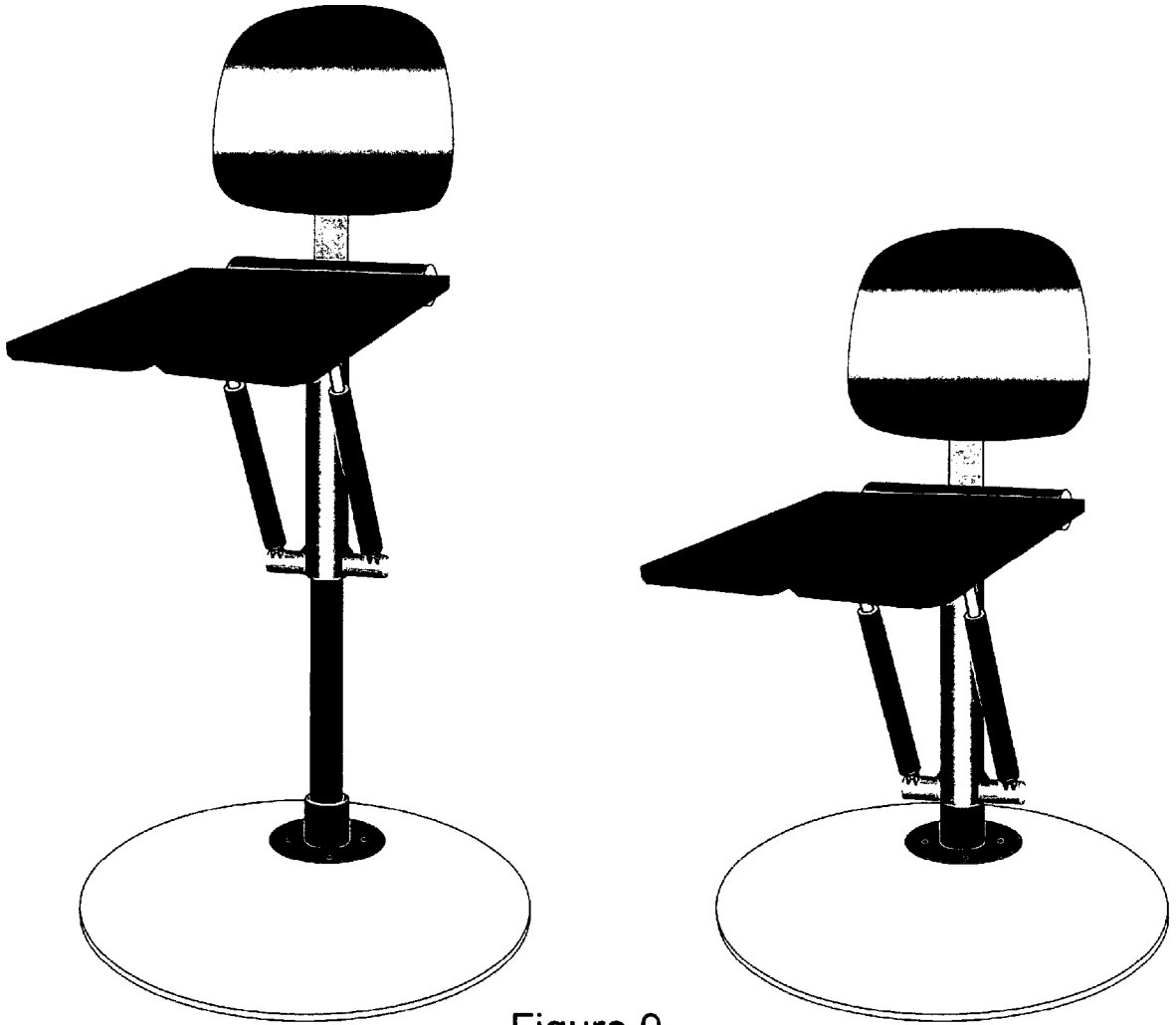
FIG. 9 shows two possible height positions with both of the half seats being in the supporting position.

FIG. 9 left panel shows a configuration of the second embodiment of the sitting device, in which both of the half seats are in supporting position. When the height is lowered in combination with the raised half seats, the sitting device becomes an ordinary chair as illustrated in the right panel of FIG. 9.

Figure 11:
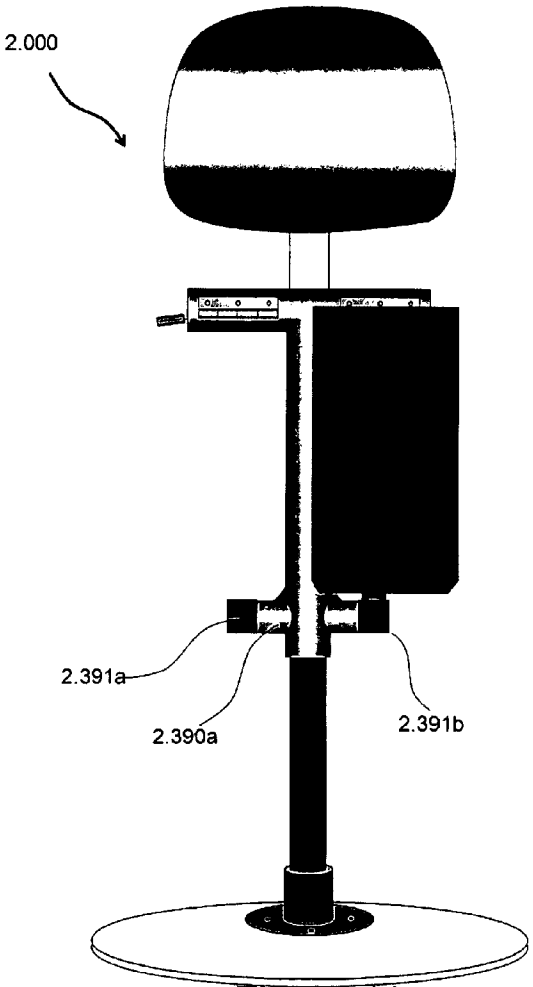
FIG. 11 is a front view of the sitting device in FIG. 10.
Figure 10:
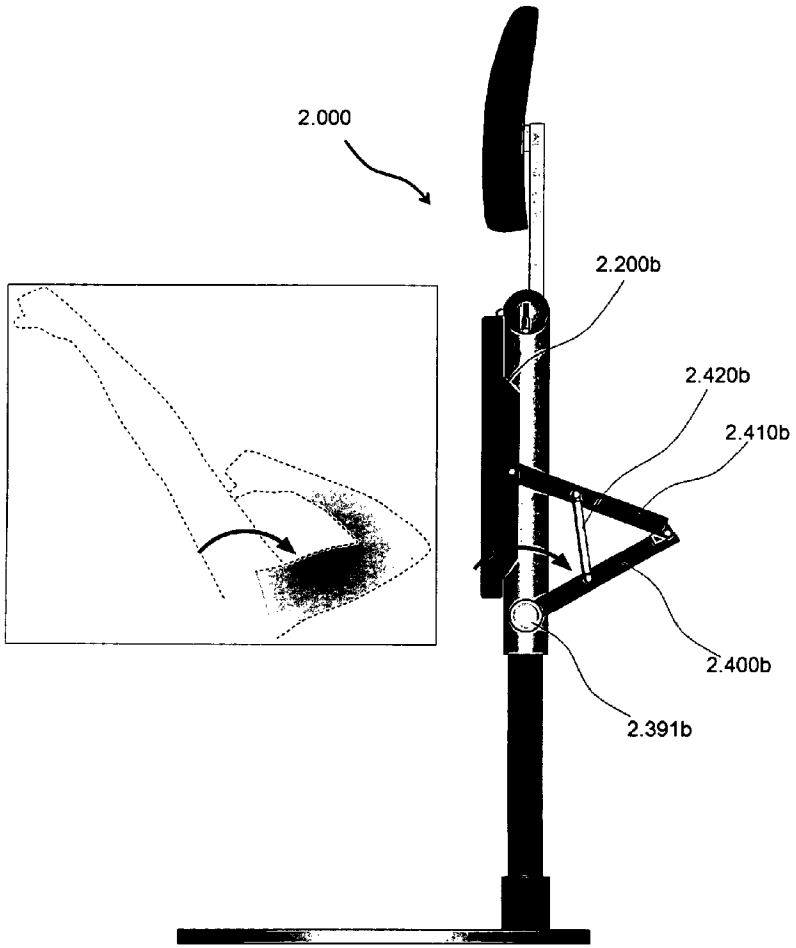
FIG. 10 is a side view of the second embodiment of the sitting device. The lower part of the supporting arm has swung backward (as indicated by the curved arrow) and the half seat is retracted. The inset shows an equivalent retracting motion of a human arm.

FIGS. 10 to 14 illustrate a second preferred embodiment of the sitting device. FIG. 10 and FIG. 11 show a side view and a front view of the second preferred embodiment of the sitting device 2.000. For clarity, one half seat has been removed. Most of the mechanisms of the second embodiment of the sitting device are the same as the ones of the first embodiment except for the half seat moving mechanism. The second embodiment uses two swinging-motion seat supporting arms each one comprised of the lower part 2.400 (a right, b left) and the upper part 2.410 (a right, b left), in contrast to the linear actuator 1.400 described in the first preferred embodiment. The lower part 2.400 and the upper part 2.410 of the seat supporting arm are linked by a shock absorber 2.420 (a right, b left). The bottom of the lower part of the seat support arm 2.400 is attached to a slowly moving rotor 2.391 (a right, b left), which is in turn secured to a perch 2.390 (a right, b left). When the rotor 2.391*b* in FIG. 10 spins clockwise the lower part of the half seat-supporting arm swings backward as illustrated by a curved arrow. This motion is equivalent to a movement of a human arm bending inward from a stretched position, as illustrated in the inset figure. This motion of the half-seat-supporting arm leads the attached half seat 2.200*b* to a retracted position.

Figure 13:
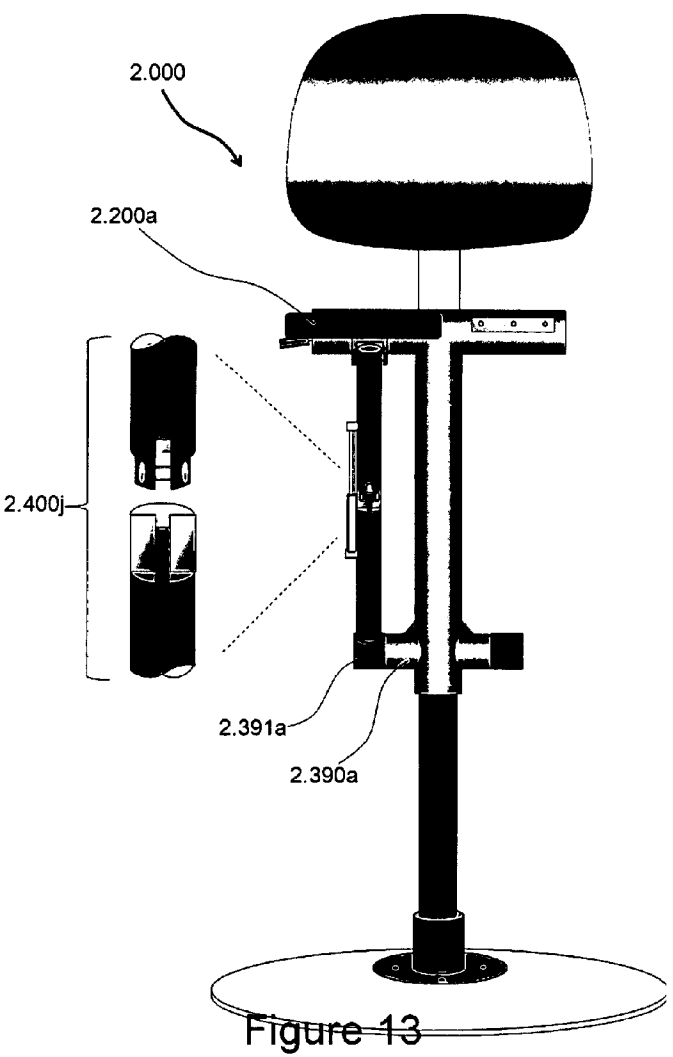
FIG. 13 is a front view of the sitting device in FIG. 12. The inset illustrates a magnified view of the joint between the upper and lower parts of the supporting arm. For clarity, the joint has been separated.
Figure 12:
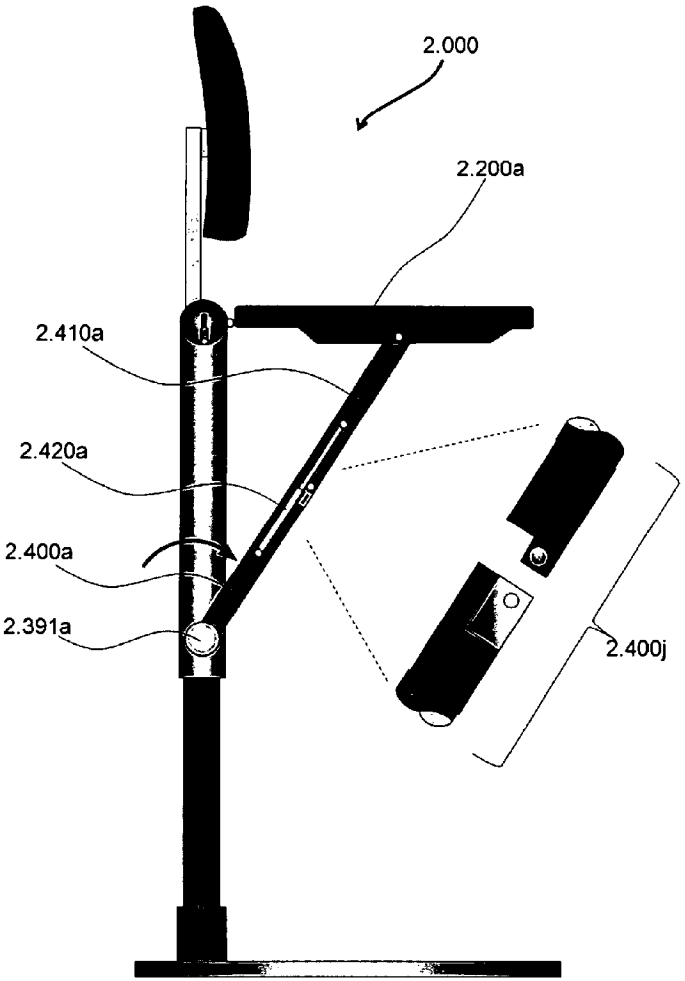
FIG. 12 is a side view of the second embodiment of the sitting device. The lower part of the supporting arm has swung forward (as indicated by a curved arrow) and the half seat is in the supporting position. The inset illustrates a magnified view of the joint between the upper and lower parts of the supporting arm. For clarity, the joint has been separated.

FIGS. 12 and 13 show a side view and a front view of the second preferred embodiment of the sitting device, respectively. When the lower part of the supporting arm 2.400*a* swings forward, indicated by a curved arrow, due to a rotating motion of the rotor 2.391*a*, the supporting arm extends (or straightens) just like a stretching human arm from a bent position therefore pushing the half chair 2.200*a* to a supporting position. The inset shows the configuration of the joint portion 2.400*j* of the lower and upper parts of the support arm. For a better illustration it shows magnified and disjointed parts. The configuration of the joint prevents the angle of the arm from going beyond 180 degrees, just like a human arm that cannot be bent outward, i.e., locks (for axial force) when straight. The inset of the FIG. 13 shows the configuration of the joint 2.400*j* from another view point. This configuration allows the supporting arm to lock naturally when it is stretched just like a human arm.

The locked supporting arm as illustrated in FIG. 12 becomes unlocked during the retraction of the half seat because the supporting arm bends. Without a motion damping mechanism, this will make the half seat collapse too quickly under the user's weight. To prevent this sudden yielding of the position of the half seat, a shock absorber 2.420*a* (b for the left) is attached linking the lower part 2.400*a* and upper part 2.410*a* of the supporting arm. While the supporting arm of this embodiment uses only two segments (lower part and upper part), many more segments can also be used. This may give a better retracting motion and also reduce the length that juts out backside of the chair when the half seat is in a retracted position.

Figure 14:
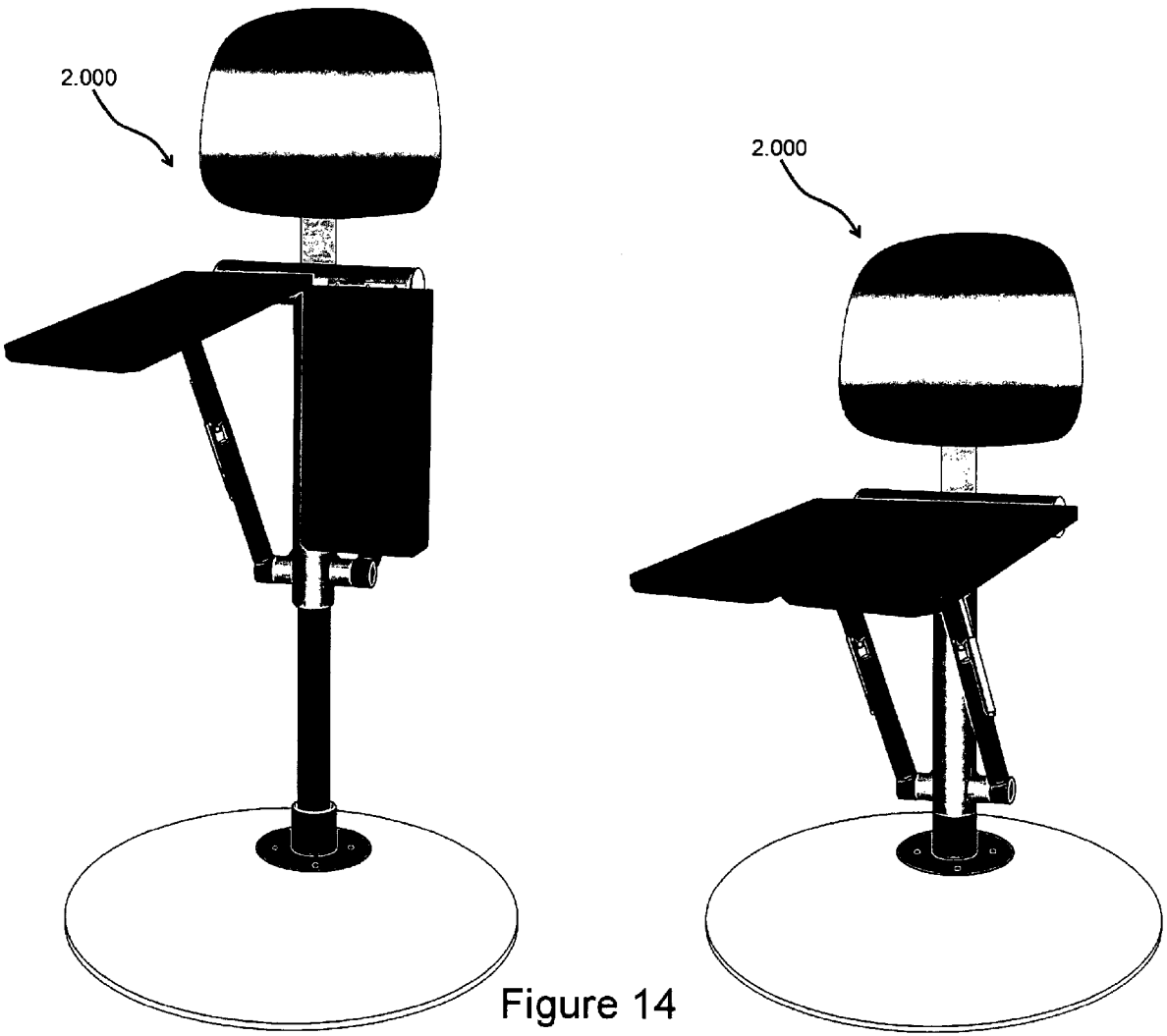
FIG. 14 is perspective views of the second embodiment of the sitting device with different heights and seat positions.

The left panel of FIG. 14 is a perspective view of the second embodiment with one half seat raised and the other retracted. The right panel of FIG. 14 is a perspective view of the second embodiment having a configuration similar to the one in FIG. 9 right pane. When both of the half seats are in the supporting position they form a full seat and the sitting device can be used as an ordinary chair.

Figure 16:
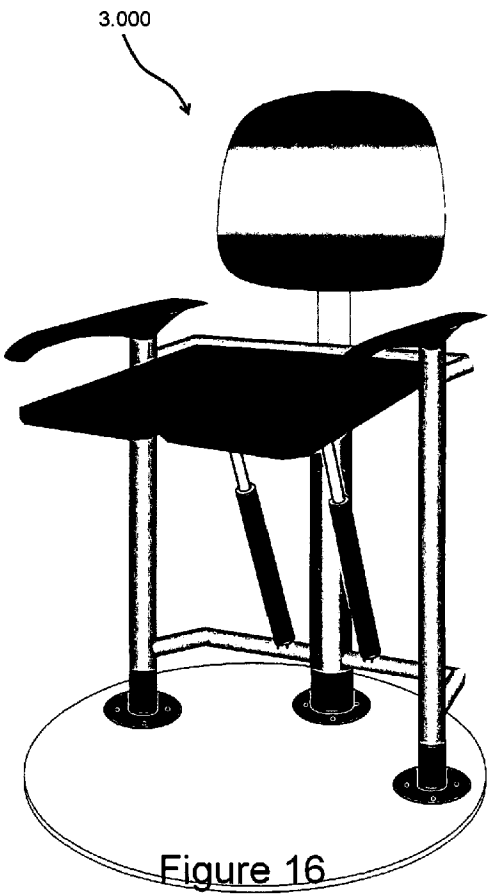
FIG. 16 illustrates a configuration of the third embodiment having both of the half seats in supporting position with lowered height.
Figure 15:
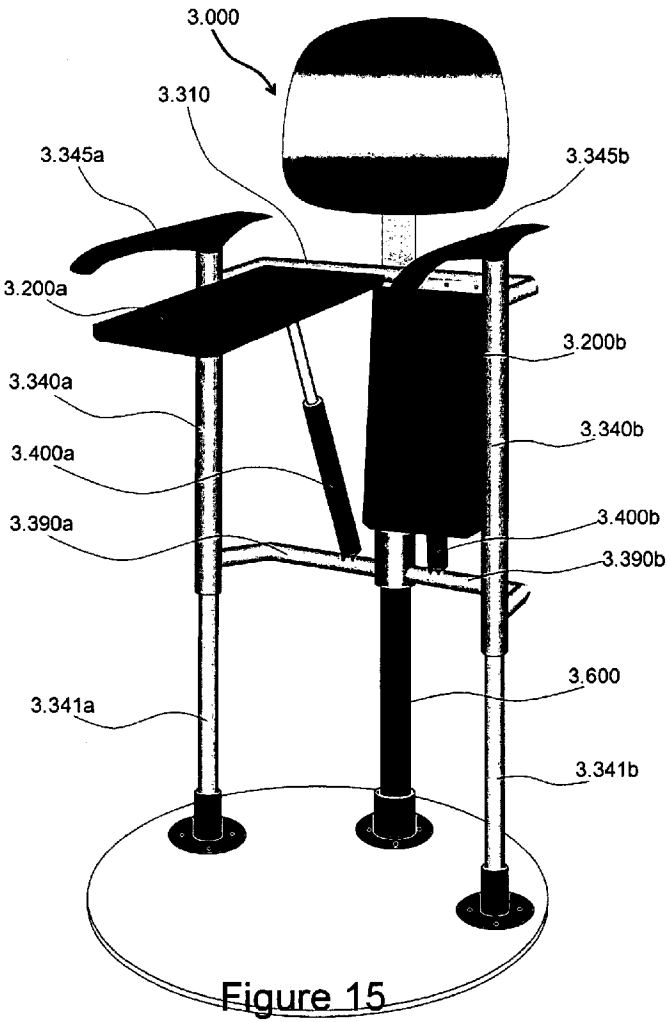
FIG. 15 is a perspective view of a third embodiment of the sitting device. Most of the configuration of this embodiment is similar to the one in the first embodiment but it adds two supporting columns for a better support of the sitting device.

FIGS. 15 and 16 show a third preferred embodiment of the invention, 3.000, with heavy duty design using two supporting columns. This embodiment is an adaptation of the first embodiment 1.000 (could be of the second one, 2.000) with two flanking supporting columns 3.341*a*, 3.341*b* and two guide tubes 3.340*a*, 3.340*b* that glide along the corresponding supporting columns. Armrests 3.345*a*, 3.345*b* are secured at the top portion of the guide tubes 3.340*a* and 3.340*b*. The middle column of the sitting device, which houses the height adjustment mechanism, is connected to the two guide tubes 3.340*a*, 3.340*b* by two horizontal crossbars, 3.310, 3.390. The upper crossbar 3.310 secures the two half seats 3.200*a*, 3.200*b*; the lower crossbar 3.390 secures the bottom of the two actuators 3.400*a*, 3.400*b* controlling the half seats. This reinforced design prevents the sitting device from a pitching motion when the half seats 3.200*a* and/or 3.200*b* are in supporting position and receive a heavy load.

The height adjustment mechanism of the third embodiment of the sitting device is similar to the ones in the first and second embodiments of the sitting device where the piston (similar to the one, 1.610, in FIG. 3) of the pneumatic cylinder 3.600 extends or retracts causing the height of the device to vary. As the height of the sitting device goes up or down, the guide tubes 3.340*a* and 3.340*b* will glide up or down along the corresponding supporting columns 3.341*a* and 3.341*b*, respectively. One example of a different sitting height is illustrated in FIG. 16 where the piston of the pneumatic cylinder has fully retracted therefore lowering the sitting position of the device 3.000, transforming the device into an ordinary chair.

Figure 17:
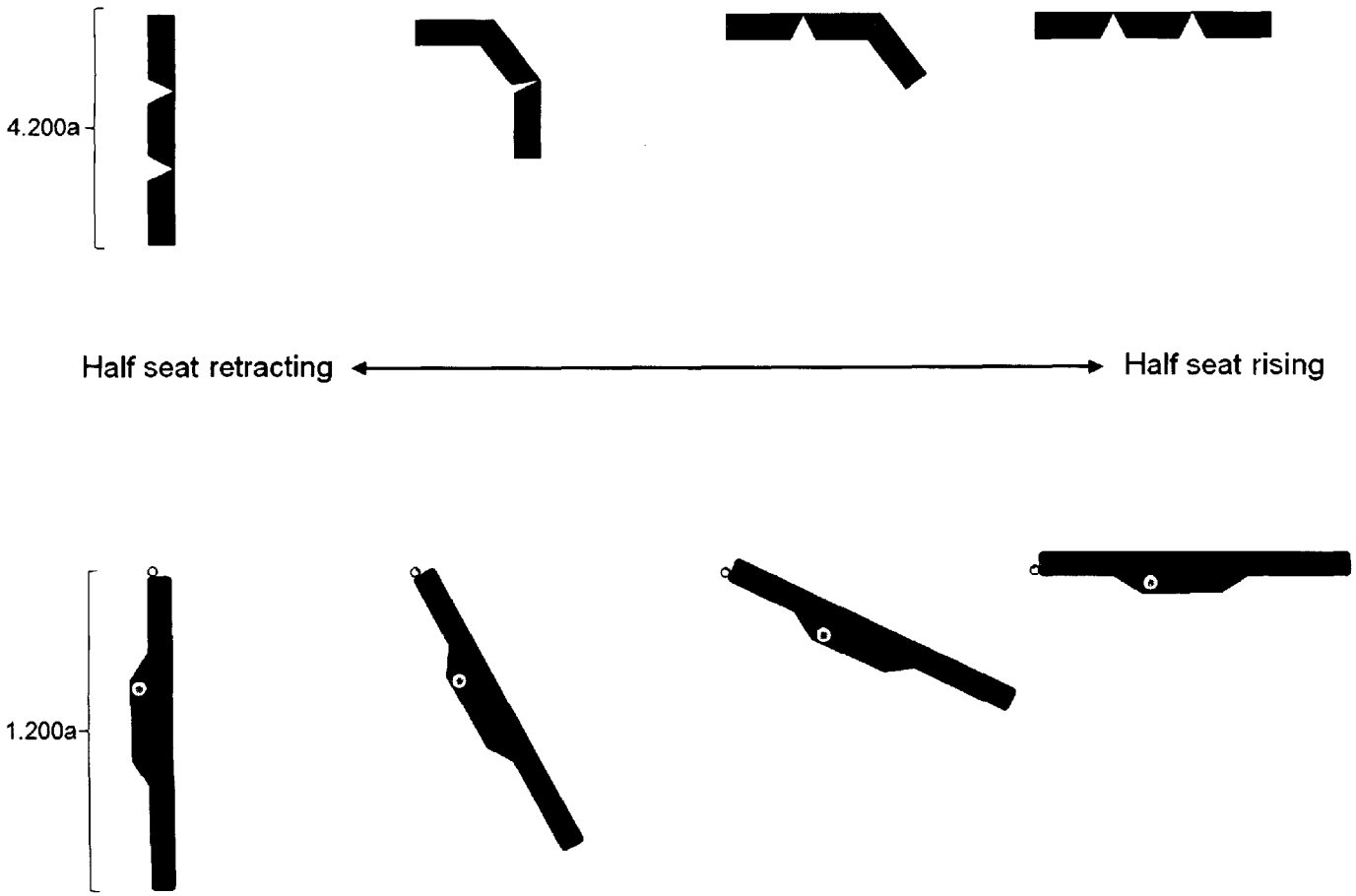
FIG. 17 is an alternative design of the half seat and its raising mechanism (upper panel, fourth embodiment). In this design many small segments of the half seat, instead of one monolithic half seat, rise or retract segment by segment in a sweeping motion. A corresponding swinging motion of the half seat in prior embodiments is illustrated in the lower panel for a comparison purpose.

The half seat raising/folding mechanism can be achieved using other alternative mechanisms. One non-limiting example (fourth embodiment) is given in the upper portion of FIG. 17. This embodiment shows an unfolding motion of a half seat, 4.200*a*, comprising 3 small segments, rising (to the right in the figure) or retracting (to the left in the figure) segment by segment in a sweeping motion. Different number of segments, or a flexible material without segments (or a hybrid including both) can be used for a smoother motion. For a comparison purpose, a corresponding swinging motion of one monolithic half seat, 1.200*a*, used in the first preferred embodiment of the sitting device, is shown in the lower portion of FIG. 17. This gradual unfolding of the seat illustrated in the upper portion of FIG. 17 may achieve a less intrusive motion for the user than the one illustrated in the lower portion of FIG. 17. Only the moving components of the half seat are shown for clarity.

Figure 18:
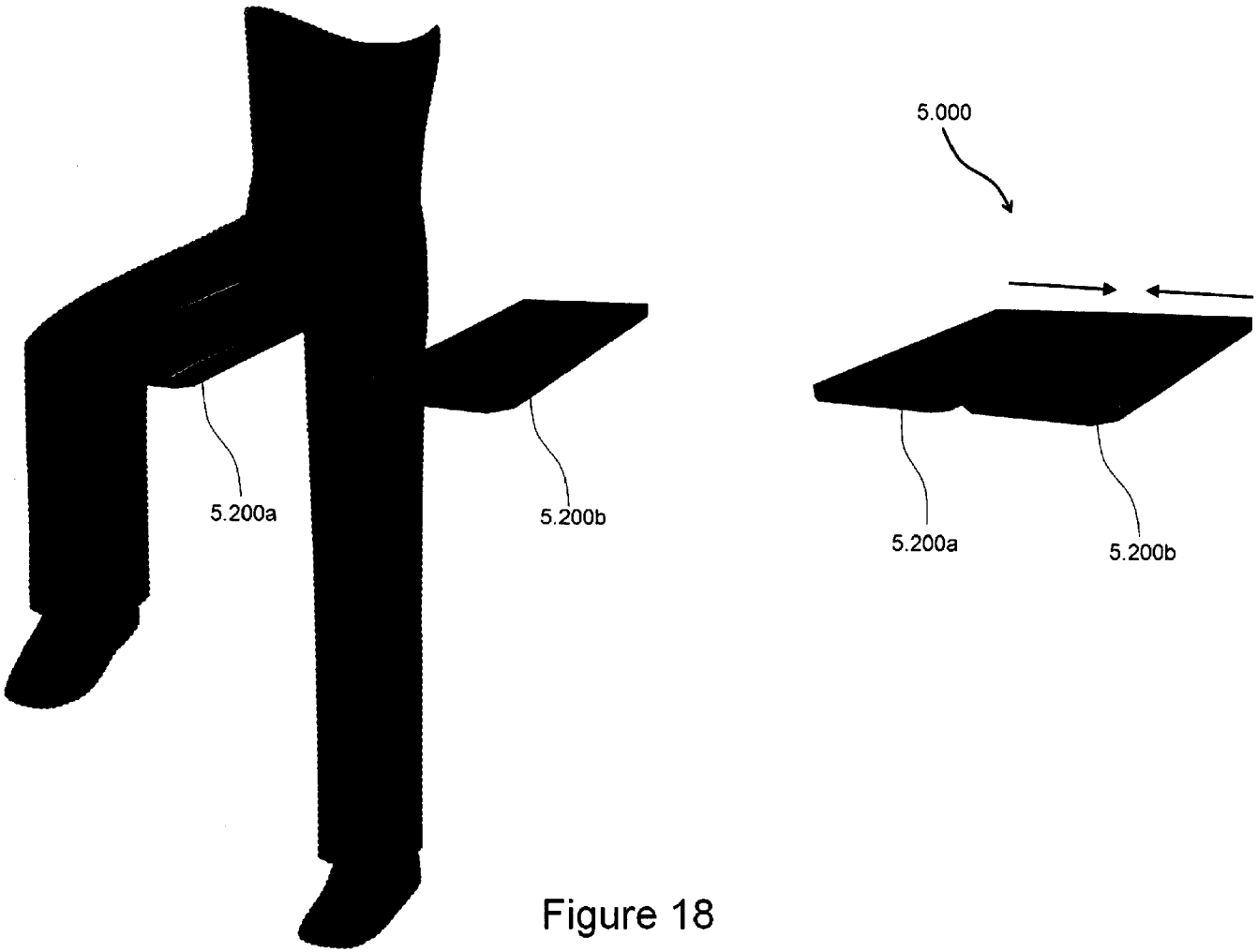
FIG. 18 shows a fifth embodiment where the two half seats are statically raised (i.e., no actuator-driven half seat raising/retracting mechanism is assumed) with a gap in between (left panel). The gap can be closed by bring the two halves closer together in a linear motion forming a full seat (right panel). Only the seat configuration is shown for clarity.

FIG. 18 shows a fifth embodiment of the sitting device, 5.000; only the half seat configurations are shown for clarity. This embodiment includes two half seats, 5.200*a*, 5.200*b*, statically raised (i.e., no actuator-driven half seat raising/lowering mechanism is assumed) with a gap in between. The user manually changes his position to sit on the right half seat or left half seat while maintaining a standing posture with the unsupported leg; one example is illustrated in the left panel of FIG. 18. The gap can be closed by bring the two halves 5.200*a*, 5.200*b* closer together in a linear motion (as illustrated by the two opposing arrows in the right panel in FIG. 18) forming a full seat. This linear motion can be achieved manually or automatically.

Figure 19:
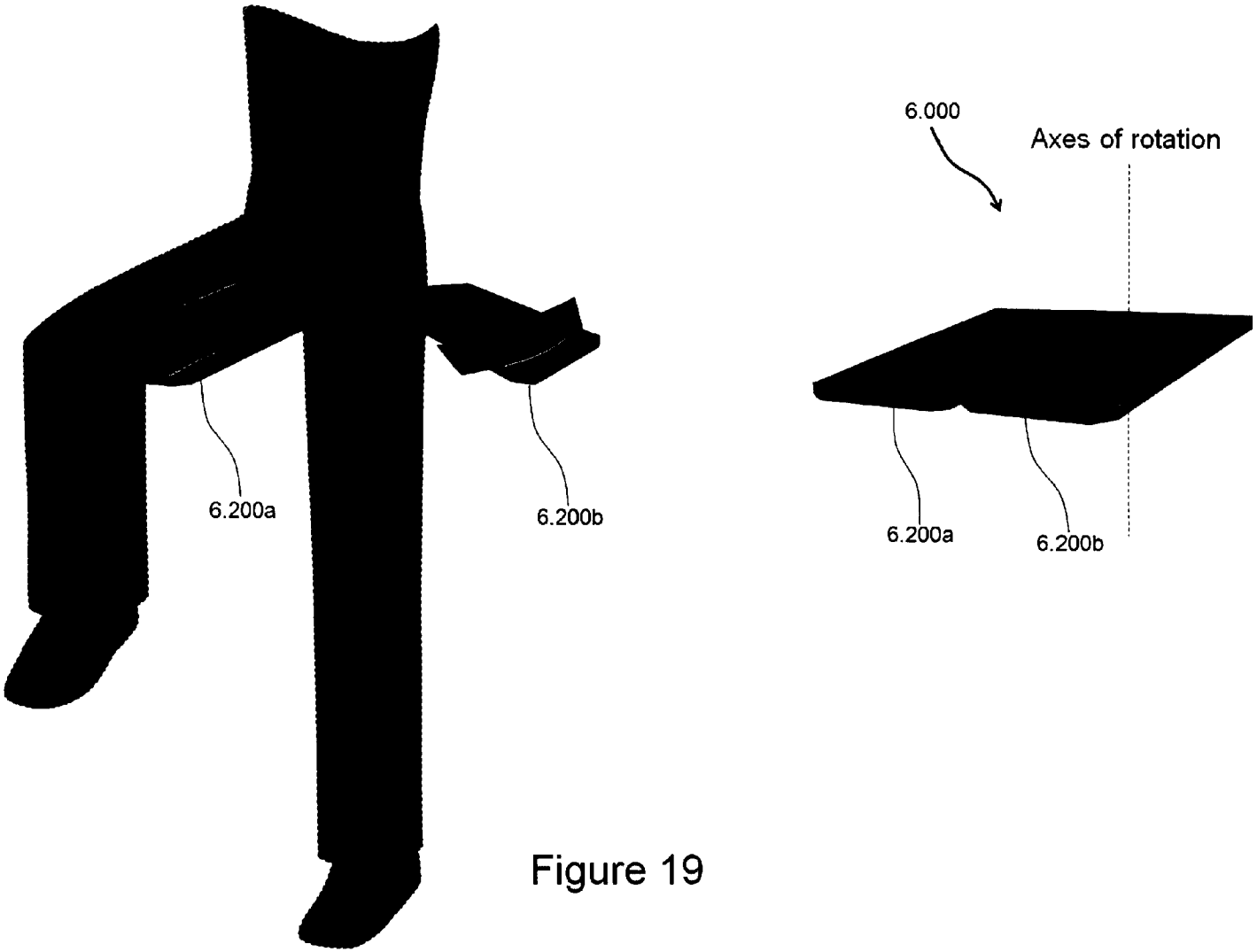
FIG. 19 shows a sixth embodiment where the two separated & statically raised half seats can be brought together by a pivoting motion. Only the seat configuration is shown for clarity.

FIG. 19 shows a sixth embodiment of the sitting device, 6.000; only the half seat configurations are shown for clarity. This embodiment includes two half seats 6.200*a*, 6.200*b* statically raised. The user manually changes his position to sit on the right half seat or left half seat while maintaining a standing posture with the unsupported leg. The two separated and statically raised half seats 6.200*a*, 6.200*b* can be brought together by a pivoting motion as illustrated by two curved and opposing arrows along a pivoting axis (illustrated by a vertical broken line on the right panel of FIG. 19) to form a full seat. This pivoting motion can be achieved manually or automatically.

Figure 20:
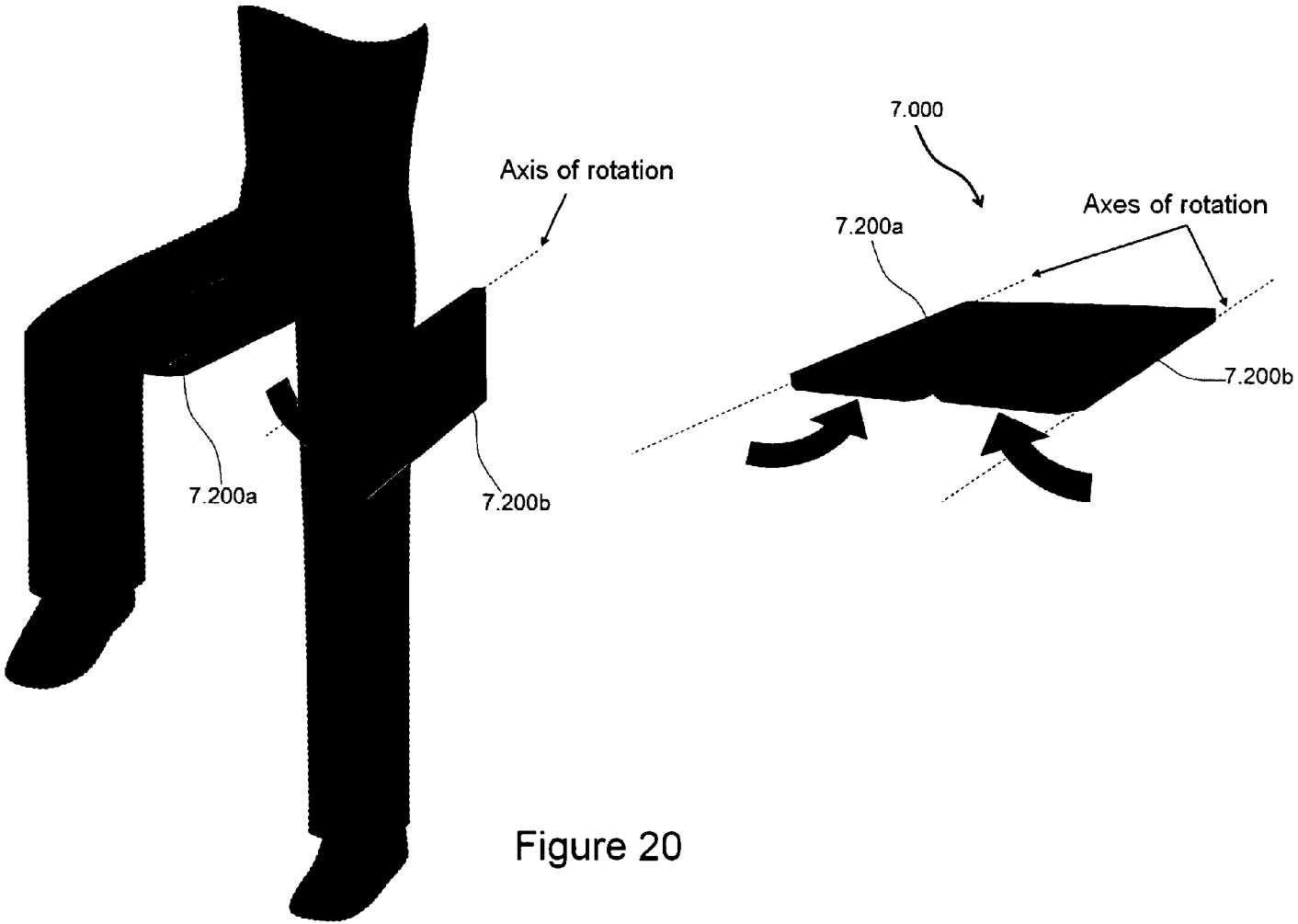
FIG. 20 shows a seventh embodiment where the two half seats are individually controlled along the two fronto-caudal parallel rotating axes. Only the seat configuration is shown for clarity.

FIG. 20 shows a seventh embodiment of the sitting device, 7.000; only the half seat configurations are shown for clarity. The embodiment includes two half seats 7.200*a*, 7.200*b* whose positions are individually controlled along the two fronto-caudal rotating axes on the left and right side of the user who is in the middle of them. This rotating motion, illustrated as arrows, can be achieved manually or automatically.

Figure 21:
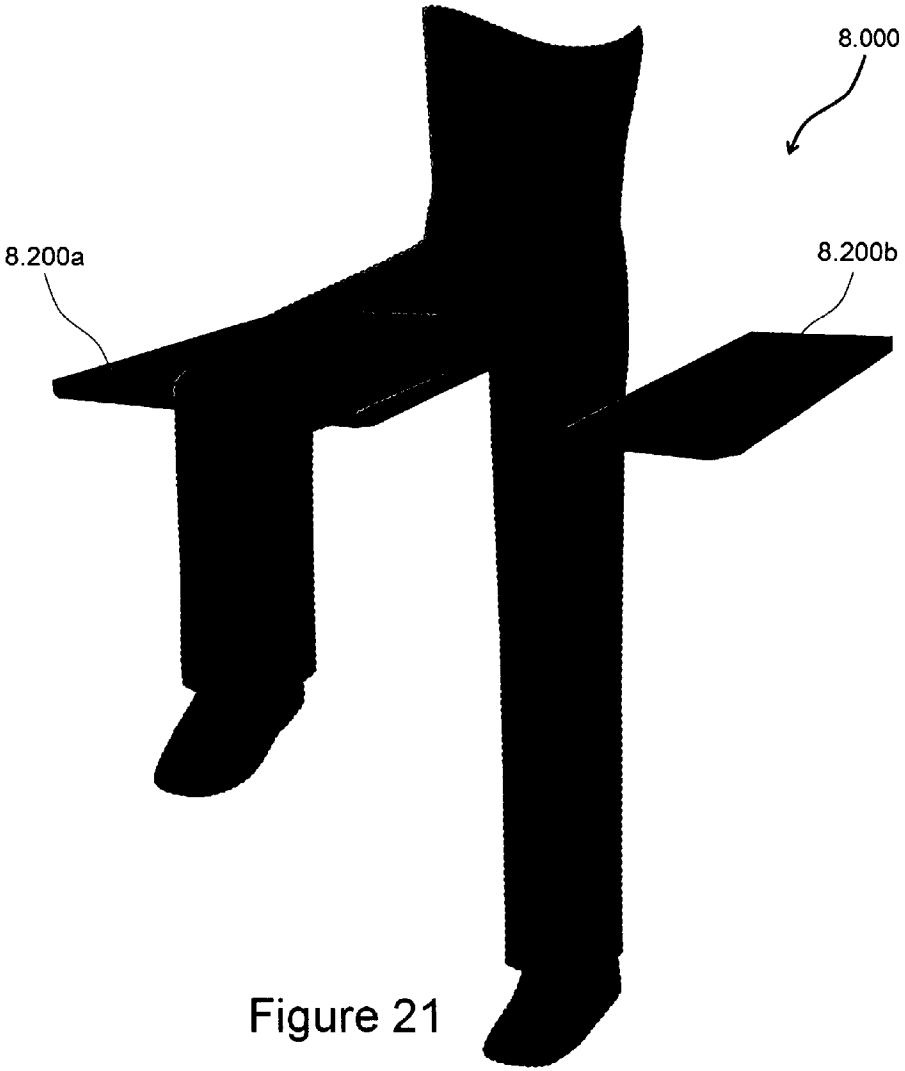
FIG. 21 shows an eighth embodiment where a statically raised full seat and a statically raised half seat (may be foldable manually) are positioned side by side with a gap in between. The user maneuvers to switch his/her positions between the two seats as he/she desires. Only the seat configuration is shown for clarity.

FIG. 21 shows an eighth embodiment of the sitting device, 8.000; only the seat configurations are shown for clarity. The embodiment includes a statically raised full seat 8.200*a* and a statically raised half seat 8.200*b* (may be foldable or removable manually) with a gap in between. The user maneuvers to switch his/her positions between the two seats as desired.

Figure 22:
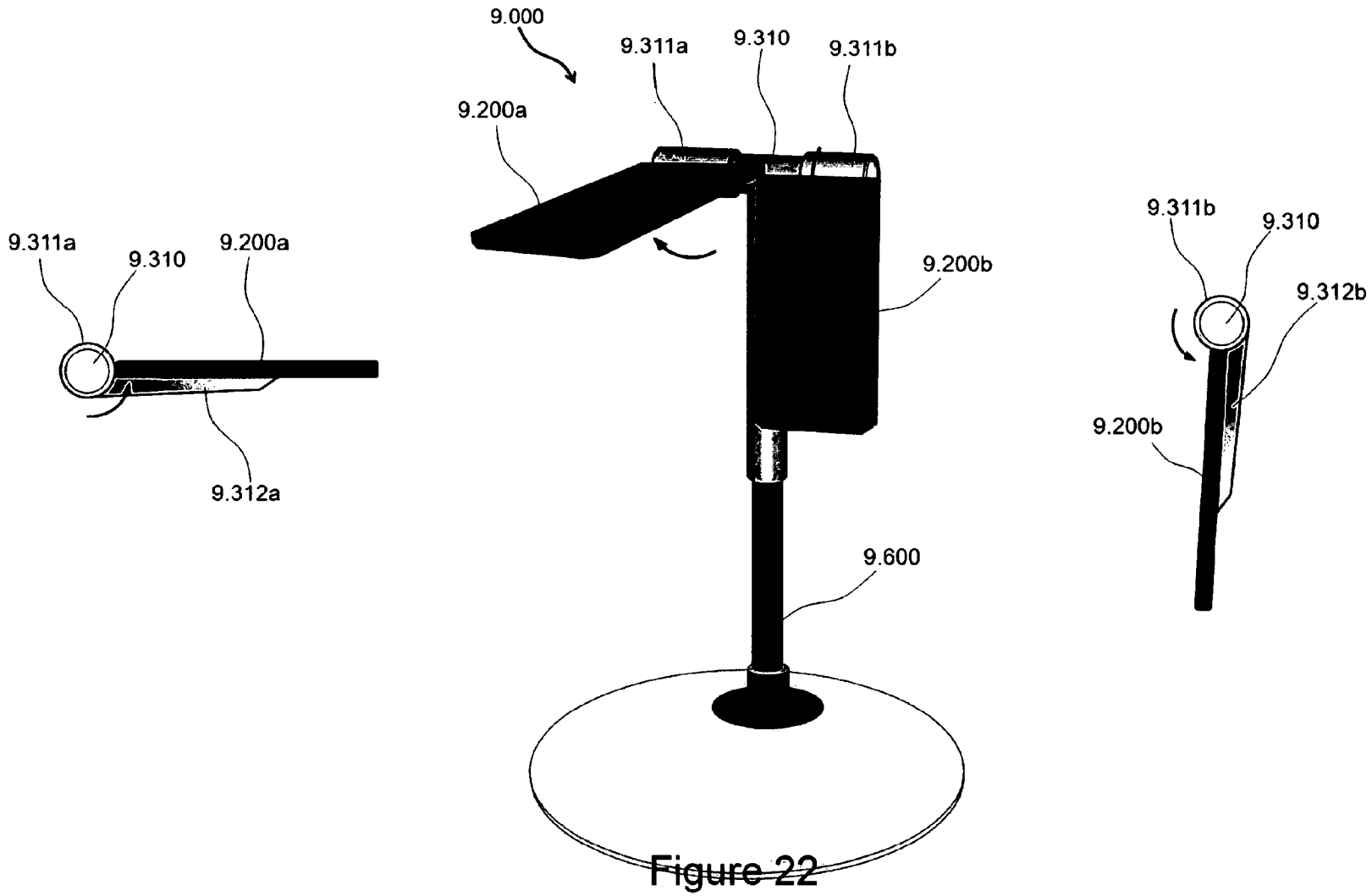
FIG. 22 shows a ninth embodiment where two slowly rotating electric gear motors that raise the half seats are encased inside the horizontal crossbar of the seat frame, therefore exposing no damageable moving parts. Only the essential parts are shown for clarity.

FIG. 22 shows a ninth embodiment of the sitting device, 9.000; only the essential parts are shown for clarity. In FIG. 22, the left panel illustrates a side view of a raised half seat 9.200*a*, attached rotor 9.311*a* and its extended arm 9.312*a* supporting the half seat. The middle panel illustrates a perspective view of the raised and folded half seats 9.200*a* and 9.200*b* along with the seat support frame 9.310, pneumatic column 9.600 and the chair base. The right panel illustrates a side view of a retracted half seat 9.200*b*, attached rotor 9.311*b* and its extended arm 9.312*b* supporting the half seat. In this design, the actuators that raise the half seats are encased inside the crossbar 9.310 of the seat support frame therefore exposing no damageable moving parts of the actuating mechanism. It is assumed to have a similar height adjusting mechanism as the one used in the first and second embodiment of the sifting device, except the height adjusting lever needs to be somewhere in the middle portion of the seat support frame 9.310 because the lateral parts of the crossbar 9.310 are occupied by the rotors. One side rotor 9.311*a*, is connected to the corresponding half seat 9.200*a* via the connected arm 9.312*a* and the other side rotor 9.311*b* is connected to the other half seat 9.200*b* via the connected arm 9.312*b*. When a rotor 9.311*a* rotates anticlockwise, illustrated as upward-curved arrows in the left and middle panels of FIG. 22, the attached half seat 9.200*a* rises to a supporting position. When the rotor 9.311*b* rotates anticlockwise, illustrated as downward-curved arrows in the middle and right panels of FIG. 22, the attached half seat 9.200*b* retracts. Each rotor is driven by a corresponding motor-gear-brake assembly (similar to the ones commonly seen in all-terrain-vehicle electric winches) fit inside of the crossbar 9.310. Namely, the right side motor-gear-brake assembly rotating the rotor 9.311*a* is encased inside and right side of the crossbar 9.310; and the left side motor-gear-brake assembly rotating the rotor 9.311*b* is encased inside and left side of the crossbar 9.310. Each rotor is a cylinder connected to the underlying corresponding motor-gear-brake assembly. The high torque motor-gear-brake assembly slowly rotates the attached cylindrical rotor (9.311*a* in case of right side) therefore rotating the attached half seat (e.g., 9.200*a*). A controller mechanism similar to the one illustrated in FIG. 8 (with the two linear actuators, 1.400*a*, 1400*b*, replaced with the two motor-gear-brake assembly) is used to drive the two motor-gear-brake assemblies and control their motion.

Figure 23:
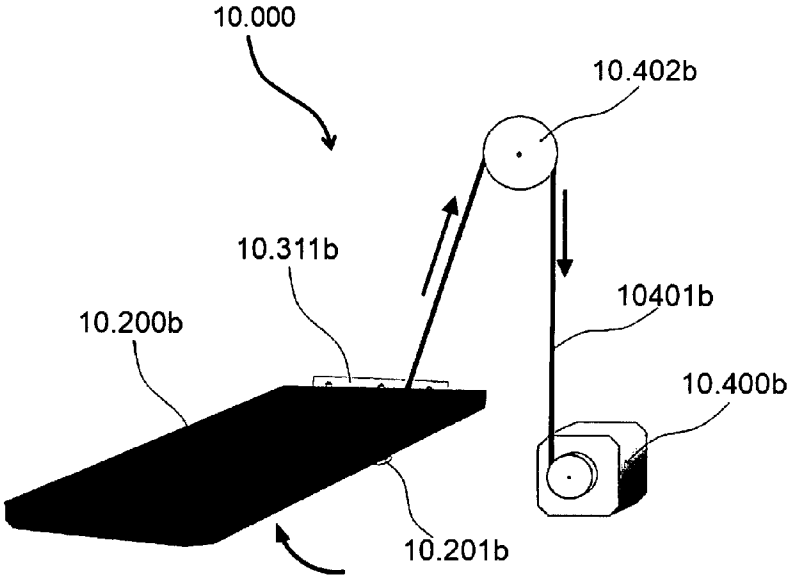
FIG. 23 shows a tenth embodiment where a cable and pulley mechanism raises or retracts the half seats (only one side of the mechanism is shown for clarity). The pulley mechanism maybe housed in or around the armrest. Only the essential parts are shown for clarity.
Figure 23:
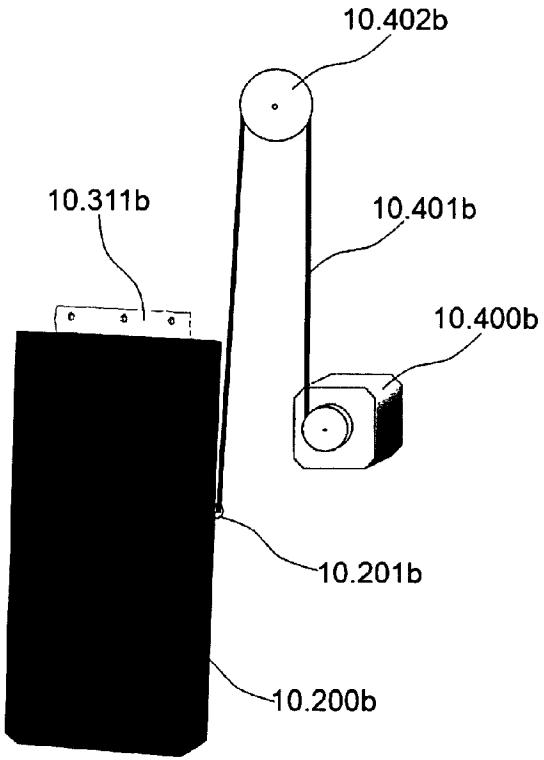

FIG. 23 shows a tenth embodiment of the sitting device, 10.000. The left panel of FIG. 23 shows a perspective view of a half seat in a retracted position, and the right panel shows a perspective view of the same half seat in a raised position. Only one side of the half-seat-position-adjusting mechanism is shown for clarity. This embodiment includes a cable 10.401*b*; a pulley 10.402*b*; a motor 10.400*b* that pulls or releases the cable; and a half seat 10.200*b* whose backend is attached preferably to the seat support frame (not shown and assumed a similar configuration as the one used in the first embodiment of the sitting device) via a hinge 10.311*b*. When one end of the cable 10.401*b* is pulled down, illustrated as a downward arrow on the right panel, the other side of the cable, whose end is attached to the half seat 10.200*b* via a link 10.201*b* gets pulled upward, illustrated as an upward arrow. This upward motion of the cable raises the half seat, illustrated as an upward curved arrow. The pulley mechanism may be housed in or around the armrest.

Figure 24:
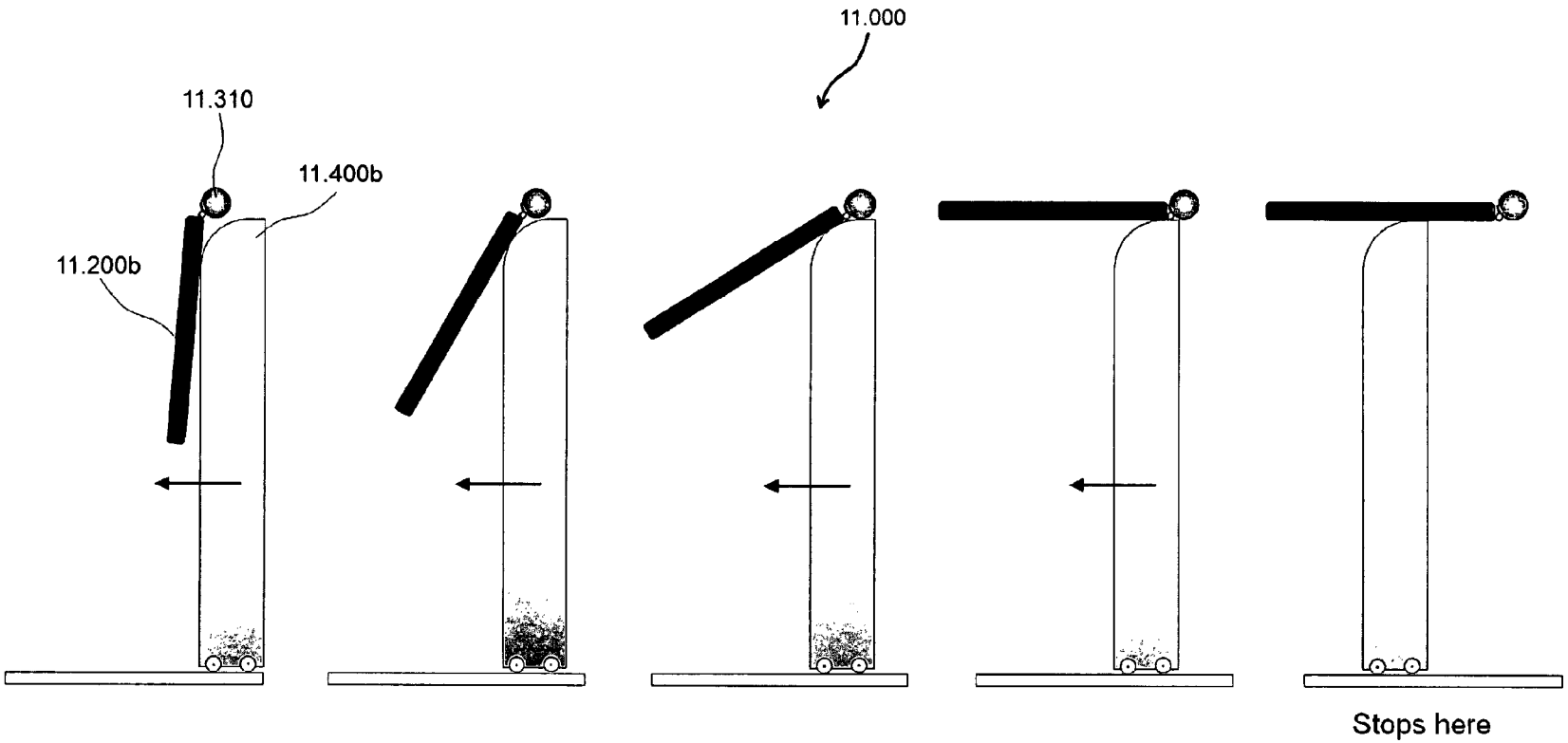
FIG. 24 shows an eleventh embodiment where a supporting beam and a half seat are shown. The moving support beam travels forward therefore push-raising the half seat, and positions itself to support the half seat. The supporting beam is supposed to be able to adjust its height to match the height of the seat. Only the essential parts are shown for clarity.

FIG. 24 shows an eleventh embodiment of the sitting device, 11.000; only one side of the half seat raising mechanism is shown for clarity. This embodiment includes a supporting beam 11.400*b*, a half seat 11.200*b* and the seat support frame 11.310. When the moving supporting beam 11.400*b* travels forward (from the left-most figure to the right-most figure) it pushes the retracted half seat to a raised position (right-most panel). A backward travel motion will let the half seat go back to the retracted position (left-most panel). The supporting beam is supposed to be able to adjust its height to match the seat height that the user sets.

REFERENCES CITED

Academic Journals

1. Deyo R A, Mirza S K, Martin B I. (2006) Back pain prevalence and visit rates: estimates from U.S. national surveys, 2002. Spine (Phila Pa. 1976). 31:2724-2727
2. Kelsey J L, White A A. (1980) Epidemiology and impact of low back pain. Spine, 5:133-142.
3. Lis A M, Black K M, Korn H, Nordin M. (2007) Association between sitting and occupational LBP. Eur Spine J. 16:283-298.
4. Battié M C, Videman T, Gibbons L E, Manninen H, Gill K, Pope M, Kaprio J. (2002) Occupational driving and lumbar disc degeneration: a case control study. Lancet. 360:1369-1374.
5. Mendelek F, Kheir R B, Caby I, Thevenon A, Pelayo P. (2011) On the quantitative relationships between individual/occupational risk factors and low back pain prevalence using nonparametric approaches. Joint Bone Spine. PMID: 21549633.
6. De Carvalho D E, Soave D, Ross K, Callaghan J P. (2010) Lumbar spine and pelvic posture between standing and sitting: a radiologic investigation including reliability and repeatability of the lumbar lordosis measure. J Manipulative Physiol Ther. 33(1):48-55.
7. O'Sullivan P B, Smith A J, Beales D J, Straker L M. (2011) Association of biopsychosocial factors with degree of slump in sitting posture and self-report of back pain in adolescents: a cross-sectional study. Phys Ther. 91(4):470-83.
8. Lengsfeld M, Frank A, van Deursen D L, Griss P. (2000) Lumbar spine curvature during office chair sitting. Med Eng Phys. 22(9):665-9

UNITED STATES PATENTS

| | | |
|---|---|---|
| 4,765,684 | August 1988 | Kvalheim et al. |
| 5,782,534 | July 1998 | Desanta |
| 3,704,847 | December 1972 | Schmitt |
| 4,738,487 | April 1988 | Shalinsky et al. |
| 4,451,086 | May 1984 | Seven |
| 7,387,339 B2 | June 2008 | Bykov et al. |
| 6,139,095 | October 2000 | Robertshaw |
| 6,357,827 B1 | March 2002 | Brightbill et al. |

What is claimed is:

1. A sitting device enabling a user to sit with one side of a lower portion of the body of the user supported, while enabling the user to maintain a standing posture with an unsupported leg of the user, which encourages the natural lordosis typical in standing posture therefore eliminating the source of sitting-related back pain, comprising:

two, left and right, half seats split along a midline wherein one half seat supports the one side of the lower portion of the body of the user;

a seat support frame; and two half-seat-position-adjusting actuators, wherein the frame includes a horizontal crossbar and a vertical guide tube, and wherein a back end of each of the two half seats are pivotally secured on the horizontal bar, the vertical guide tube housing a length-changing mechanism to vary the height of the sitting device and a height fixing mechanism which prevents yielding of the height of the sitting device when the user sits, the two half-seat-position-adjusting actuators being attached at one end of each to the vertical tube and at the other end to the respective half seat.

2. The sitting device according to claim 1, further comprising a foot stool for the foot to rest on in case the foot is raised.

3. The sitting device according to claim 1, wherein the half seats can be individually raised to a horizontal position or lowered to a vertical position thereby enabling the user to use the device as an ordinary chair by having both of the two half seats in horizontal position and enabling the user to freely stand by lowering both half seats to the vertical position.

4. The sitting device according to claim 3 wherein each a half seat comprises many small segments linked pivotally together.

5. The sitting device according to claim 3, a mechanism for raising and lowering the half seats of the sitting device including a controller having raise/lower buttons to change the positions of the half seats individually.

6. The sitting device according to claim 5 wherein the controller includes a programmable timer to define how frequently the half seats change positions (or alternate) through a sequence of postures of the user's choice.

7. The sitting device according to claim 1, wherein the height fixing mechanism includes a band brake, the length-changing mechanism includes a pneumatic cylinder, and the sitting device further comprises a height-adjusting lever operatively connected with the length-changing mechanism and the height fixing mechanism such that by lifting motion of the height-adjusting lever, the user 1) disables the height fix by releasing the grip of the band brake around the pneumatic cylinder and then; 2) engages height adjustment by pressing the gas-release button on top of the pneumatic cylinder, and when the height-adjusting lever is released from the lifted position, the user 1) disables the height changing mechanism by releasing the gas-releasing button on top of the pneumatic cylinder from its pressed state and then; 2) fixes the height by pulling the cable of the band brake.

8. The sitting device according to claim 1 wherein the two half-seat-position-adjusting actuators comprise linear motion actuators to raise or lower the half seats, a bottom part of each actuator being secured to the lower portion of the vertical guide tube, a top part of the actuator being secured to the bottom of the respective half seat via a bracket.

9. The sitting device according to claim 1 wherein the two half-seat-position-adjusting actuators comprise a rotor and a supporting arm for each half seat having a bottom is attached to the rotor and a top part attached to the bottom of the half seat, the supporting arm locks when a lower part of the arm and an upper part of the arm form a substantially straight line thereby preventing yielding of the seat position even when the user sits.

10. The sitting device according to claim 9 wherein each half-seat-position-adjusting actuator further includes a shock absorber to prevent a sudden sinking motion of the half seat when the supporting arm retracts from the locked supporting position.

11. The sitting device according to claim 1, wherein the two half seats are statically positioned with a gap in between, the gap being closeable by bring the two half seats closer together in a linear lateral motion forming a full seat.

12. The sitting device according to claim 11 wherein the two separated statically positioned half seats can be brought together by a pivoting motion.

13. The sitting device according to claim 1, wherein the positions of two half seats are individually controlled along two fronto-caudal rotating axes.

14. The sitting device according to claim 1, including a statically raised full seat and a statically raised half seat with a gap in between, whereby the user maneuvers to switch positions between the two seats as desired.

15. The sitting device according to claim 1, further comprising a seat support frame, two half-seat-position-adjusting actuators, the frame including a horizontal crossbar and a vertical guide tube, wherein a backend of each of the two half seats are pivotally secured on the horizontal bar, the actuators being encased inside the crossbar and including a rotor attached to the crossbar, therefore exposing no damageable moving parts of the actuating mechanism.

16. The sitting device according to claim 1, wherein the actuators each include a cable and pulley mechanism to raise or retract the half seats.

17. The sitting device according to claim 1, wherein the actuators include two individually controlled supporting beams, one for each half seat, the beams being static for a given height of the sitting device, each supporting beam traveling along the fronto-caudal axes of the sitting device, whereby when the respective beam travels forward the beam push-raises the corresponding half seat using its statically raised height and positions itself to support the bottom of the half seat.

18. The sitting device according to claim 1, further comprising armrests, a back support and one of casters and a base including a turn table, to allow movement or rotation of the whole sitting device.

* * * * *